US011712134B2

(12) United States Patent
Broussard

(10) Patent No.: US 11,712,134 B2
(45) Date of Patent: Aug. 1, 2023

(54) SHOWER APPARATUS AND METHOD

(71) Applicant: Andrew Broussard, Hemphill, TX (US)

(72) Inventor: Andrew Broussard, Hemphill, TX (US)

( * ) Notice: Subject to any disclaimer, the term of this patent is extended or adjusted under 35 U.S.C. 154(b) by 63 days.

(21) Appl. No.: 17/331,727

(22) Filed: May 27, 2021

(65) Prior Publication Data

US 2021/0282601 A1 Sep. 16, 2021

Related U.S. Application Data

(62) Division of application No. 16/388,956, filed on Apr. 19, 2019, now Pat. No. 11,026,546.

(51) Int. Cl.
*A47K 3/38* (2006.01)

(52) U.S. Cl.
CPC ..... *A47K 3/38* (2013.01)

(58) Field of Classification Search
CPC ..... A47K 3/38
USPC ..... 4/607–610, 557, 605
See application file for complete search history.

(56) References Cited

U.S. PATENT DOCUMENTS

| | | | | |
|---|---|---|---|---|
| 4,229,842 | A * | 10/1980 | Gilmore | A47K 3/38 4/610 |
| 5,103,531 | A * | 4/1992 | Perrotta | A47K 3/38 4/608 |
| 5,305,477 | A | 4/1994 | Cochran | |
| 5,732,420 | A | 3/1998 | Micciche | |
| 6,996,862 | B1 | 2/2006 | Shippy et al. | |
| 8,151,384 | B2 * | 4/2012 | Jankiewicz | A47K 3/38 4/610 |
| 9,833,113 | B2 | 12/2017 | Royal | |

* cited by examiner

*Primary Examiner* — Tuan N Nguyen
(74) *Attorney, Agent, or Firm* — George L Williamson

(57) ABSTRACT

Apparatus and method for an improved shower appurtenance for bracing a shower curtain away from a user including a hanger clip configured for removable connection with a shower curtain rod and a base rod with a first end and a second end where the first end is connected with the hanger clip. A base plate assembly is connected to the second end of the base rod and an arm or a pair or arms movably connected with the base plate such that the arm or the pair of arms are moveable from an undeployed position to a deployed position where the undeployed position is approximately parallel to the base rod and the deployed position is approximately perpendicular to the base rod.

14 Claims, 6 Drawing Sheets

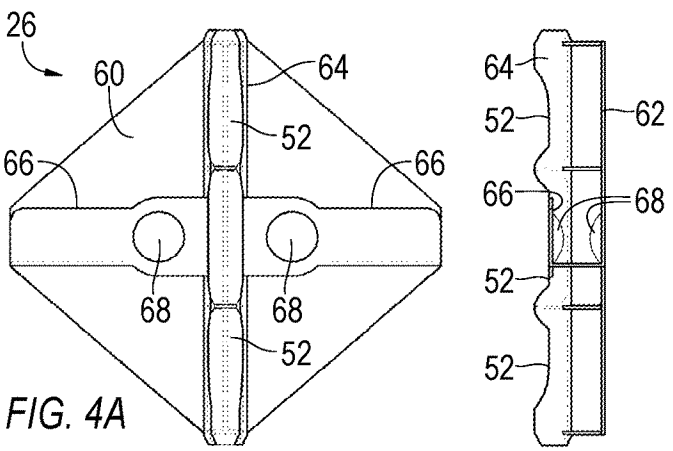
FIG. 4A
FIG. 4B
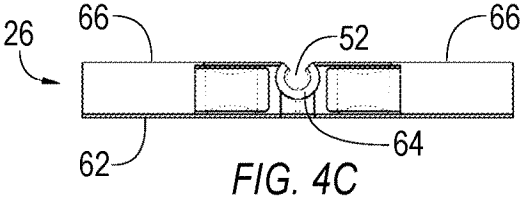
FIG. 4C
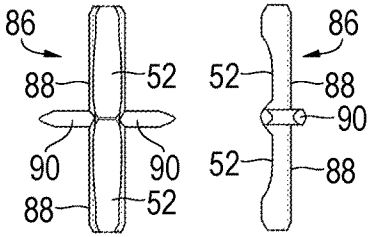
FIG. 7A
FIG. 7B
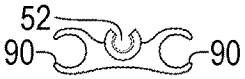
FIG. 7C
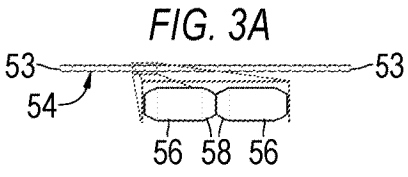
FIG. 3A
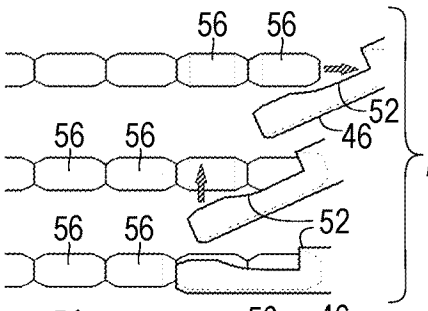
FIG. 3B
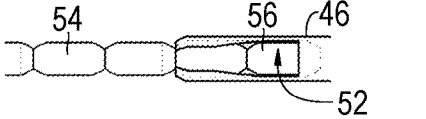
FIG. 3C
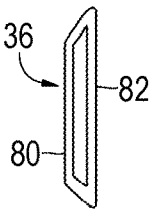
FIG. 6B
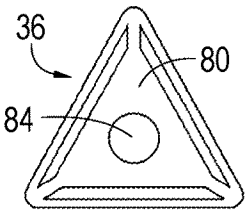
FIG. 6A
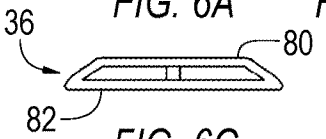
FIG. 6C
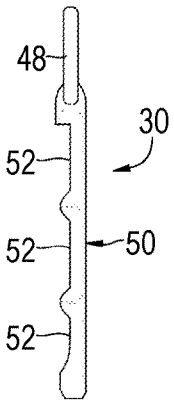
FIG. 2B
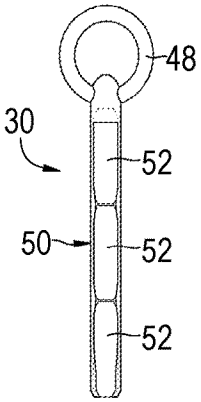
FIG. 2A
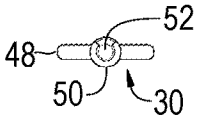
FIG. 2C
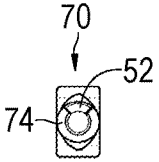
FIG. 5B
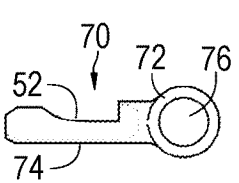
FIG. 5A
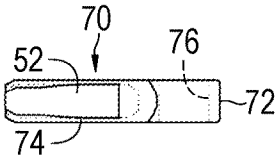
FIG. 5C

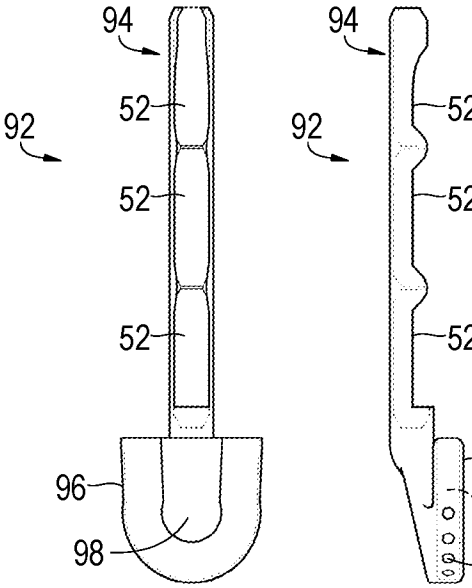
FIG. 8B
FIG. 8A
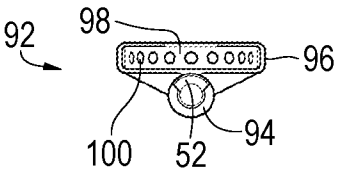
FIG. 8C
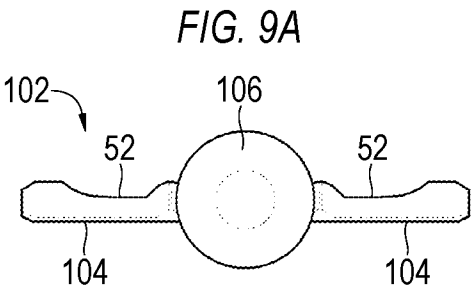
FIG. 9A
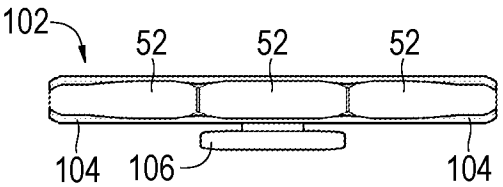
FIG. 9C
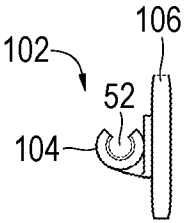
FIG. 9B

SHOWER APPARATUS AND METHOD

BACKGROUND OF THE INVENTION

Field of the Invention

The present invention relates generally to shower appurtenances and, more particularly, is concerned with an improved apparatus and method for bracing a shower curtain away from a user.

Shower curtains hang down from shower curtain rods and complete the process of enclosing a user in the shower. The problem is that in many cases the resulting shower space is limited and restricted because heated air within the enclosed shower space rises, causing an area of low-pressure toward the bottom. This causes the cooler, higher-pressure air from outside the shower to push inside, bringing the curtain with it and subsequently reducing the already-small shower space even further. Many attempts have been made to solve this problem. Manufacturing a curved shower rod forces the curtain away from the shower space but comes at an increased cost and installation difficulty. It also leaves the shower curtain's center of gravity high, still allowing its bottom to encroach on the useable shower space.

Description of the Related Art

Devices relevant to the present invention have been described in the related art, however, none of the related art devices disclose the unique features of the present invention.

In U.S. Pat. No. 5,732,420 dated Mar. 31, 1998, Micciche disclosed an apparatus for controlling a shower curtain or a shower liner. In U.S. Pat. No. 5,305,477 dated Apr. 26, 1994, Cochran disclosed a shower curtain brace. In U.S. Pat. No. 9,833,113 dated Dec. 5, 2017, Royal disclosed an expanding curtain. In U.S. Pat. No. 6,996,862 dated Feb. 14, 2006, Shippy et al. disclosed a shower curtain deflector.

However, none of the prior art, including these devices, are the same or similar structurally and none are as easy and economical to install and operate as the present invention. There is a need in the art for a process that addresses the aforementioned problems in a manner that is robust and flexible so as to accommodate a full spectrum of shower enclosure shapes and dimensions.

While these devices may be suitable for the purposes for which they were designed, they would not be as suitable for the purposes of the present invention as hereinafter described. As will be shown by way of explanation and drawings, the present invention works in a novel manner and differently from the related art.

SUMMARY OF THE PRESENT INVENTION

The present invention discloses an improved shower apparatus and method for bracing a shower curtain away from a user having a hanger clip configured for removable connection with a shower curtain rod. Also included is a base rod with a first end and a second end where the first end is connected with the hanger clip. A base plate assembly is connected to the second end of the base rod along with an arm being movably connected with the base plate such that the arm is moveable from an undeployed position to a deployed position where the deployed position is approximately perpendicular to the base rod.

In a further aspect, in the undeployed position the arm is approximately parallel to the base rod.

In another aspect, the arm includes a length and a center point along its length and a pivot point connection proximate the center point where the pivot point connection is connected with the base rod.

In one aspect the arm is a pair of independent arms.

In one aspect, when in the deployed position the arm and/or the pair of arms form a curved arch structure such that the curved arch structure extends horizontally away from the second end of the base rod.

In another aspect, the pair of arms include a first end and a second end where the first ends are connected with the base plate and where the second ends are configured to removably connect with side walls of a shower.

In yet another aspect, the apparatus further includes an anchor plate attached to the arm and/or to each of the pair of arms such that in the deployed state an anchor plate on the arm and/or pair of arms removably connects with the side walls of a shower.

In another aspect, the apparatus further includes more than one base rod, base plate and arm and/or pair of arms.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including equivalent constructions to those described herein insofar as they do not depart from the spirit and scope of the present invention.

For example, the specific sequence of the described process may be altered so that certain processes are conducted in parallel or independent, with other processes, to the extent that the processes are not dependent upon each other. Thus, the specific order of steps described herein is not to be considered implying a specific sequence of steps to perform the process. In alternative embodiments, one or more process steps may be implemented by a user-assisted process and/or manually. Other alterations or modifications of the above processes are also contemplated. For example, further insubstantial approximations of the process and/or algorithms are also considered within the scope of the processes described herein.

In addition, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

Is should also be noted that a plurality of hardware and software-based devices, as well as a plurality of different structural components, may be utilized to implement the invention. Furthermore, and as described in subsequent paragraphs, the specific configurations illustrated in the drawings are intended to exemplify embodiments of the invention and that other alternative configurations are possible.

An object of the present invention is to provide an improved shower apparatus for increasing the space between a shower curtain and a user that is easy to use and economical to install and operate. A further object of the present invention is to provide an improved shower apparatus which can be relatively easily and inexpensively manufactured. A further object of the present invention is to provide an improved shower apparatus which can be easily operated by a user.

The present invention is designed to be a simple, expedient solution to the common problem of a wandering shower curtain that encroaches on a user's bathing space during his or her shower; it can be custom-sized by the user to a wide variety of shower dimensions. Because of its modifiable nature, the present invention is more universal in its function than similar products. For instance, it can be used on step-in showers, where no significant bottom edge is present that other products require, such as the side of a bath tub.

The present invention is capable of being suspended from most shower curtain hanger designs without modification. It works in conjunction with an existing shower curtain rod to provide a complementary framework that braces the shower curtain away from the user. This framework ensures that the useable bathing space during a shower is either maintained or is even expanded, while maintaining the water barrier for which the curtain is primarily purposed.

Some of the advantages of the present invention follow: 1) It creates extensively more shower space at the user's chest level; 2) It is simple to install using the existing shower curtain bar; 3) It has an excellent projected price point; 4) It completely restrains the bottom of the shower curtain; 5) It is completely hidden when not in use; 6) The shower curtain open/close capabilities is in no way diminished; 7) It maintains a warm air pocket for after-shower drying; 8) It requires minimal shower curtain extension at its bottom to maintain the water barrier; 9) It can combine with another unit of the present invention to form an extended frame for larger showers; and, 10) It is expected to be constructed of widely available and inexpensive plastic.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views. The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which:

FIG. 2A is a plan view of a hanger clip of the present invention.

FIG. 2B is a side view of a hanger clip of the present invention.

FIG. 2C is an end view of a hanger clip of the present invention.

FIG. 3A is an exploded view of portions of a segmented rod of the present invention.

FIG. 3B are side elevation views showing the sequence of installing the segmented rod into a receptacle as used with the present invention.

FIG. 3C is a top view of the segmented rod installed in a receptacle of the present invention.

FIG. 4A is a plan view of a first embodiment of a base plate of the present invention.

FIG. 4B is a side view of a first embodiment of a base plate of the present invention.

FIG. 4C is a bottom view of a first embodiment of a base plate of the present invention.

FIG. 5A is a side view of a first embodiment of a rotation clip of the present invention.

FIG. 5B is an end view of a first embodiment of a rotation clip of the present invention.

FIG. 5C is a top view of a first embodiment of a rotation clip of the present invention.

FIG. 6A is a plan view of an anchor plate of the present invention.

FIG. 6B is a side view of an anchor plate of the present invention.

FIG. 6C is a bottom view of an anchor plate of the present invention.

FIG. 7A is a plan view of a stowage clip of the present invention.

FIG. 7B is a side view of a stowage clip of the present invention.

FIG. 7C is an end view of a stowage clip of the present invention.

FIG. 8A is a plan view of a second embodiment of a base plate of the present invention.

FIG. 8B is a side view of a second embodiment of a base plate of the present invention.

FIG. 8C is a top view of a second embodiment of a base plate of the present invention.

FIG. 9A is a side view of a second embodiment of a rotation clip of the present invention.

FIG. 98 is an end view of a second embodiment of a rotation clip of the present invention.

FIG. 9C is a top view of a second embodiment of a rotation clip of the present invention.

LIST OF REFERENCE NUMERALS

Figure 1B:
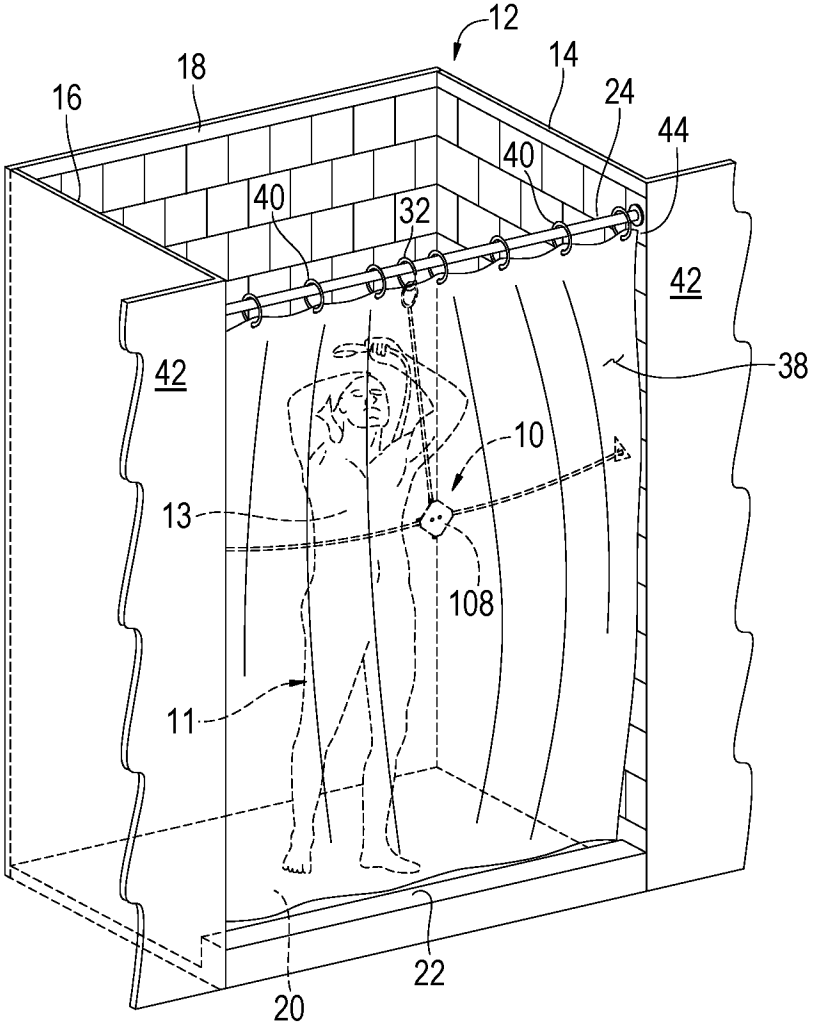
FIG. 1B is a perspective view of a first embodiment of the present invention shown in operative connection including a shower curtain.

With regard to reference numerals used, the following numbering is used throughout the drawings.

10 present invention
11 user
12 shower stall unit
13 chest level
14 right side wall
16 left side wall
18 rear side wall
20 floor
22 curb
24 rod of shower
26 a first embodiment of the base plate
28 base rod disposed vertically
30 hanger clip
32 ring for shower rod
34 rod disposed horizontally
36 anchor plate
38 curtain
40 curtain ring for shower rod
42 exterior wall
44 seam
48 ring
50 body
52 receptacle
53 end of rod
54 segmented rod
56 individual segment
58 thin portion
60 front side
62 backside
64 vertical spline
66 U-shaped channels
68 indention/indent
70 rotation clip
72 ring
74 member
76 aperture
80 front side
82 backside
84 aperture
86 stowage clip
88 body
90 clip portion
92 second embodiment of base plate clip
94 body
96 second receptacle
98 interior space
100 drainage aperture
102 second embodiment of rotation clip
104 body
106 circular disk
108 first embodiment of base plate assembly
110 drainage aperture
112 second embodiment of base plate assembly

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1A through 17 illustrate the present invention wherein an improved apparatus and method for bracing a shower curtain away from a user is illustrated and which is generally indicated by reference number 10.

Figure 1A:
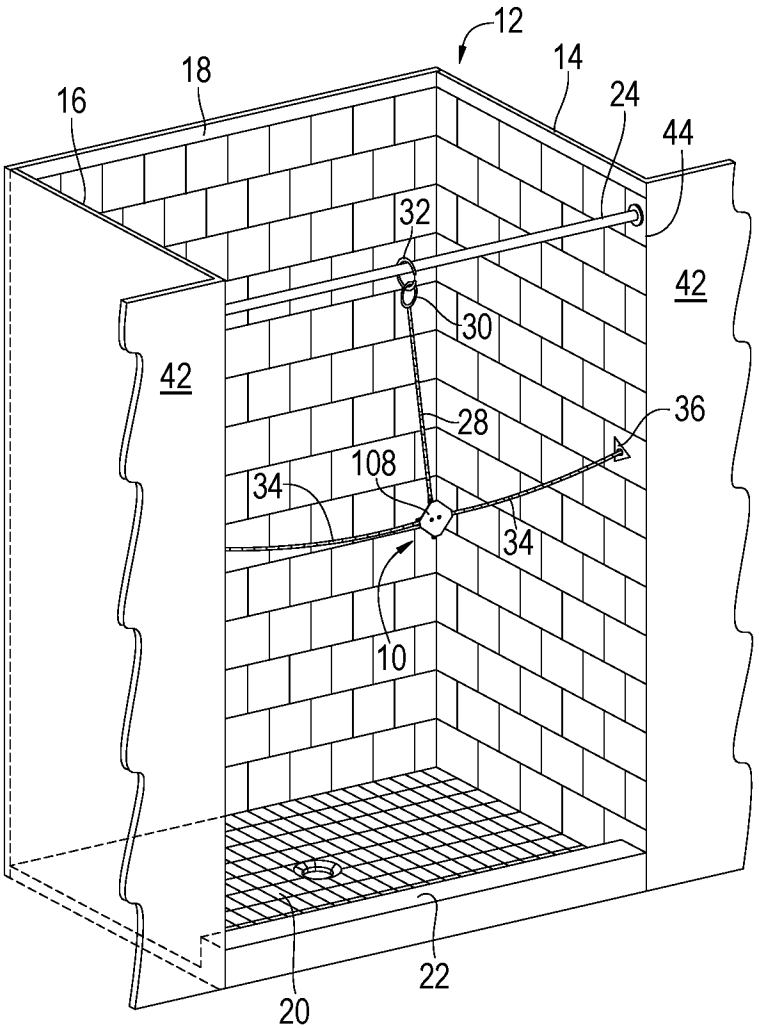
FIG. 1A is a perspective view of a first embodiment of the present invention shown in operative connection.

Turning to FIG. 1A, therein is shown the present invention 10 disposed on the inside of a conventional shower unit 12 having a right side wall 14, a left side wall 16, a rear sidewall 18, along with a floor 20 with drain, and a curb 22. Also shown is a conventional shower rod 24 installed in the conventional manner extending from one side wall to the other side wall 14, 16 and having a base plate assembly 108 of the present invention 10 installed on the interior of the shower unit 12 wherein the base plate assembly 108 is attached to a lower end of a supporting base rod 28 extending in the vertical direction which is attached to the shower rod 24 using a hanger clip 30 attached to a conventional ring 32 for use on the shower rod 24. Also shown extending to the right and left sides of the base plate assembly 108 are folding arm rods 34 extending in a lateral direction having one end connected to the base plate assembly 108 and a second end connected to an anchor plate 36 which is attached to the side walls 14, 16 of the shower stall 12 using an adhesive backing or hook and loop material, or the like. Also shown are right and left exterior walls 42 on the sides outside of the shower unit 12 along with a seam 44 which is shown between the shower unit 12 and the wall 42 as would be done in the standard manner.

Turning to FIG. 1B, therein are shown the same elements as previously disclosed relative to FIG. 1A, and also shown is a user 11 having a chest 13 and also showing a shower curtain 38 which is installed and hung in the conventional manner using a plurality of shower curtain rings 40 attached onto the shower rod 24 in the conventional manner. It can be seen in FIGS. 1A and 1B that the rods 34 of the present invention 10 are curved or arched outwardly away from the user 11 in the shower unit 12 so as to enlarge the space in the shower unit by causing the curtain 38 to be positioned or braced away from a user 11 inside the shower unit.

Referring generally to FIGS. 2A-9B, therein are shown the individual components which are used in a modular-like manner to assemble the present invention 10.

Turning to FIGS. 2A-2C, therein are shown the hanger clip 30 having a ring 48 thereon along with a body 50 having a plurality of receptacles 52 therein wherein each receptacle is sized and shaped to receive and frictionally hold two segments 56 of the segmented rod 54, as shown in FIG. 3A, the rods having individual segments 56 wherein the individual segments are connected to each other by a very thin portion 58 which is left in place during the manufacturing process of the rod 54. This will be discussed further relative to FIGS. 3A-3C.

Turning to FIGS. 3A-3C, therein is shown the rod, being generally indicated at 54, being made up of a plurality of individual cylindrical-like segments 56 wherein each segment is joined by a thin portion 58 as previously disclosed so that the thin portion 58 allows the rod 54 to be easily cut or broken into user selected lengths. FIG. 3B shows a sequence of the manner or steps in which the segments 56 of the rod 54 are installed into a receptacle 52 of a hanger clip 46, or any other component of the present invention 10 having a receptacle 52, illustrating that each receptacle 52 is appropriately sized and shaped to receive two segments 56 of rod 54. FIG. 3C shows a top view of the individual segments 56 of rod 54 as it appears after installation into a receptacle 52 as taught by the present invention 10. As taught by the present invention 10 there may be a series of individual receptacles 52 each having first and second ends wherein the first end of a first receptacle is connected or continued to a second end of a second receptacle in a repeating manner so as to form a series of or plurality of receptacles each sized to receive two segments of a segmented rod 54 all of which would be understood by one skilled in the art.

Turning to FIGS. 4A-4C, therein is shown the base plate 26, the rear side 62 of which is visible in and disclosed in FIG. 1A, the base plate 26 having a front side 60, a backside 62, a vertical spline 64 running from one end to the other end, and containing a plurality of receptacles 52 in series which again are designed to each receive and frictionally hold two individual rod segments 56 as previously disclosed. Also shown are right and left U-shaped channels 66 perpendicular to spline 64 along with right and left indents or indentions 68 the purpose of which is to receive an aperture 76 of a rotation clip 70 which will be disclosed hereinafter. Base plate 26 is shown being square shaped but could assume other shapes as well.

Turning to FIGS. 5A-5C, therein is shown a rotation clip 70 having a circular ring 72 on one end and having a portion 74 on the other end containing a receptacle 52. The circular ring 72 of the rotation clip 70 has an aperture 76 centrally disposed therein which aperture is designed to receive the indent 68 of the base plate 26 so that the rotation clip 70 can be secured within the U-shaped channels 66 wherein the rotation clip 70 can rotate between a substantially horizontally disposed position and a substantially vertically disposed position. The receptacles 52 of the rotation clip 70 are sized to receive two segments 56 of rod 54 as previously disclosed.

Turning to FIG. 6A-6C, therein are shown an anchor plate 36 having a front side or surface 80 and a backside or surface 82 including an aperture 84 disposed on the front side wherein the aperture is designed to receive an end 53 of the rod 34 as is shown in FIG. 1A. The backside 82 of the anchor plate 36 is attached to the side walls 14, 16 of the shower stall 12 using an adhesive backing, hook and loop material, or the like.

Figure 17:
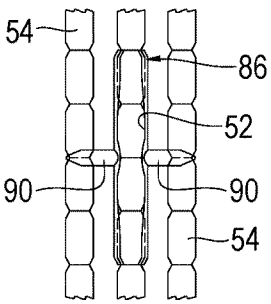
FIG. 17 is a detailed plan view of a stowage clip of the present invention shown in operative connection.

Turning to FIGS. 7A-7C, therein is shown a stowage clip 86 having a body 88 containing receptacles 52 and additionally having a pair of clips 90 thereon wherein the clips are sized to receive a segment 56 of a rod 54 so that the rod 54 can be stowed in a vertical disposition by attaching a stowage clip to the vertical rod and then attaching the lateral rods into the clips 90. Clips 90 form a receptacle for frictionally holding the rod 54 as best seen in FIG. 17.

Turning to FIGS. 8A-8C, therein is shown the second embodiment of a base plate clip 92 having a body portion 94 containing a plurality of receptacles 52 along with a second receptacle 96 having an interior space 98 therein along with a plurality of drainage apertures 100 which are used to drain water from the receptacle 96.

Turning to FIGS. 9A-9C, therein is shown a second embodiment of a rotation clip 102 having a body portion 104 along with a circular disk portion 106 wherein the circular disk portion 106 is designed to be inserted into and removed from the space 98 of the second receptacle 96 of the second embodiment of the base plate clip 92.

Figure 10:
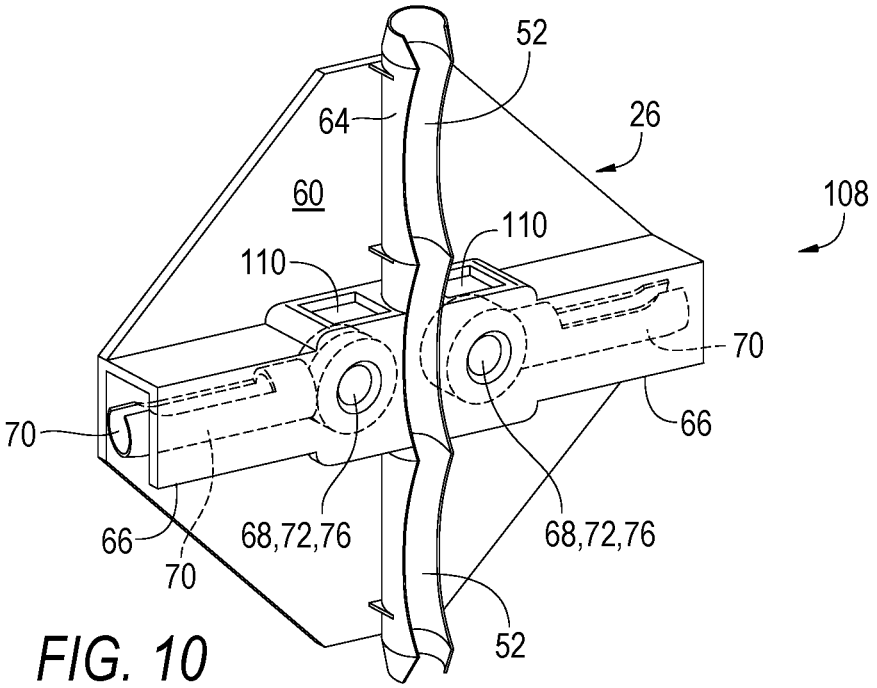
FIG. 10 is a front perspective view of one embodiment of the base plate assembly of the present invention.

Turning to FIG. 10, therein is shown a first embodiment of the base plate assembly 108 which includes the base plate 26 as previously disclosed including a pair of rotation clips 70, the base plate 26 having a front side 60 along with a vertical spline 64 having a plurality of receptacles 52 therein including the U shaped channels 66 all of which has been previously disclosed relative to the FIGS. 4A-4C. Also shown are right and left rotation clips 70 disposed in the U-shaped channels 66 wherein the aperture 76 of the ring 72 of the rotation clips 70 are disposed in the U-shaped channels 66 so that the rotation clip can be easily rotated from substantially the horizontal position to substantially the vertical position. The aperture 76 of the ring 72 of the rotation clips 70 are disposed in the U-shaped channels 66 by placing the indents 68 of base plate 26 into the apertures 76 of the rotation clip 70. Also shown are right and left drainage apertures 110 for removing water from the U-shaped channels 66.

Figure 11:
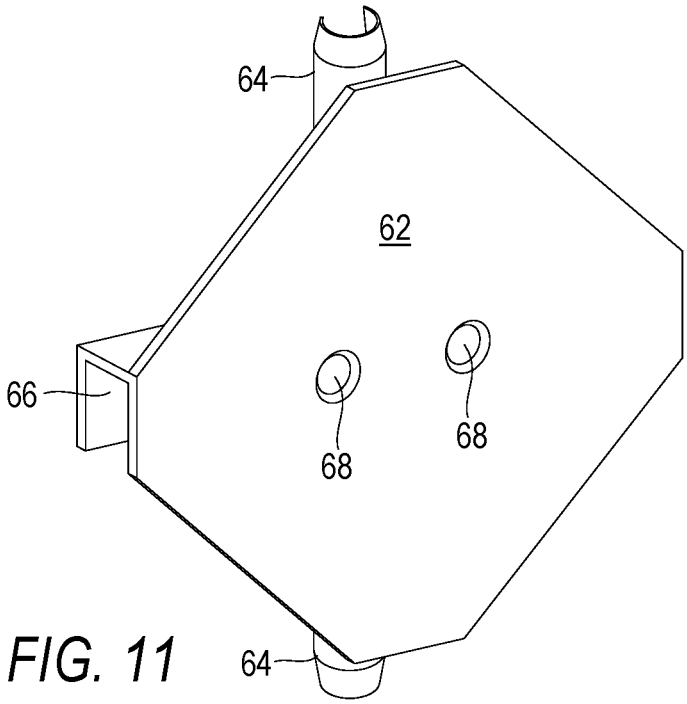
FIG. 11 is a rear perspective view of one embodiment of the base plate assembly of the present invention.

Turning to FIG. 11, therein is shown the backside 62 of the base plate 26 along with the vertical spline 64, U-shaped channels 66, and indentions 68 which is similar to the view as shown in FIG. 1A as previously disclosed.

Figure 12:
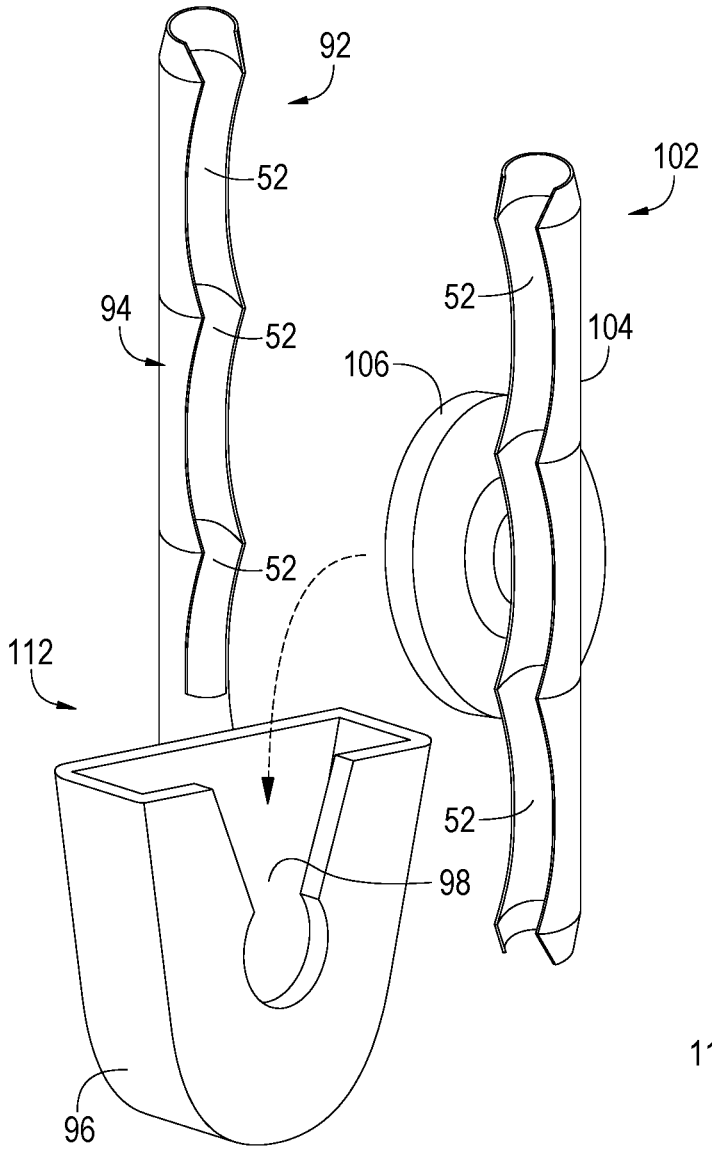
FIG. 12 is a front perspective view of a second embodiment of the base plate assembly of the present invention showing a rotation clip exploded away.
Figure 13:
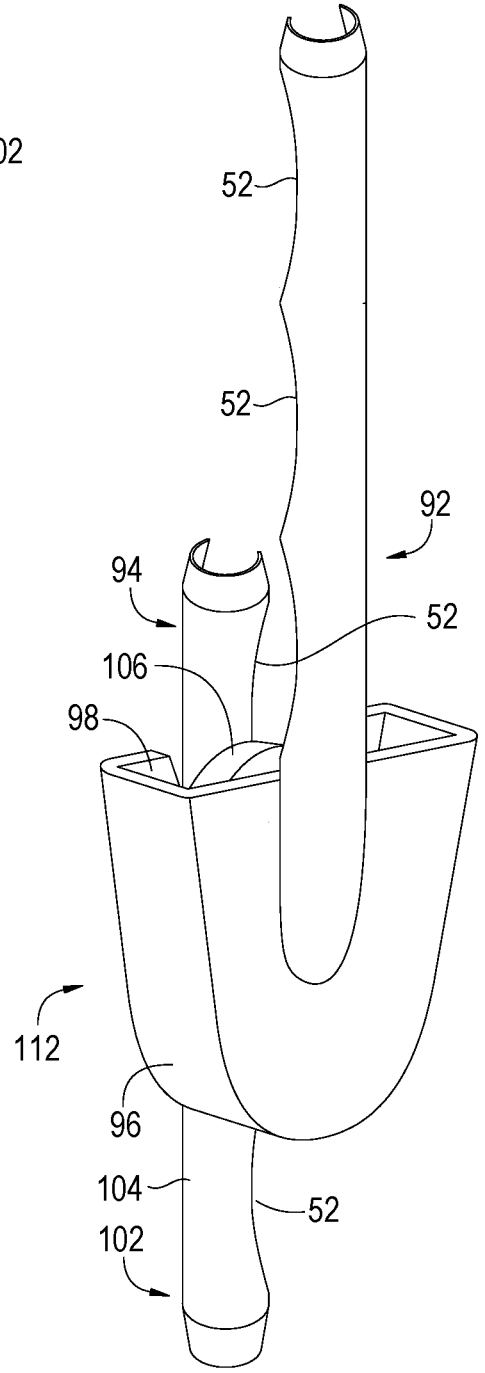
FIG. 13 is a rear perspective view of a second embodiment of the base plate assembly of the present invention.

Turning to FIGS. 12-13, therein is shown a second embodiment of a base plate assembly 112 including a second embodiment of the base plate clip 92 having a body portion 94 along with a plurality of receptacles 52 including a second receptacle 96 having an interior space 98 therein for receiving the circular disc portion 106 of a second embodiment of the rotation clip 102 which has been previously disclosed in FIGS. 8A-8C and FIGS. 9A-9C.

Figure 14A:
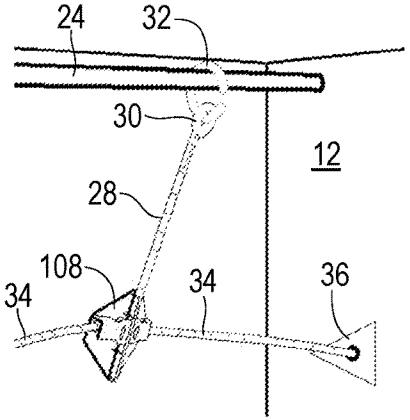
FIG. 14A is a perspective view taken from inside a shower unit showing a first embodiment of the base plate assembly in a deployed position.

Turning to FIG. 14A, therein is shown one embodiment of the base plate assembly 108 in a deployed in position inside a shower unit 12 which has been shown previously in FIG. 1A and described relative to FIG. 1A.

Figure 14B:
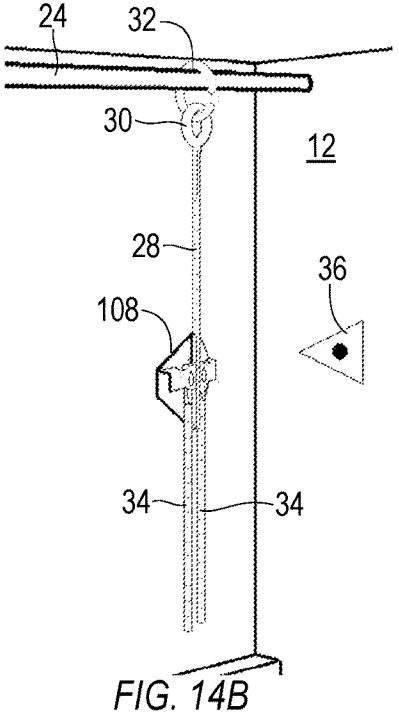
FIG. 14B is a perspective view taken from inside a shower unit showing a first embodiment of the base plate assembly in a stowed position.

Turning to FIG. 14B, therein is shown one embodiment of the base plate assembly 108 with the rods 34 in a downwardly stowed position inside a shower unit 12 showing the present invention 10 including the elements previously disclosed in FIG. 1A. The rods 34 could also be stowed in an upward position by using a stowage clip as shown in FIG. 17.

Figure 15A:
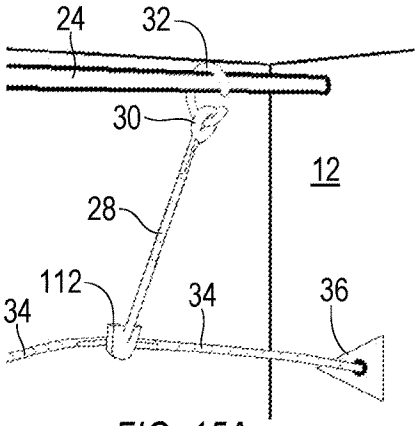
FIG. 15A is a perspective view taken from inside a shower unit showing a second embodiment of the base plate assembly in a deployed position.

Turning to FIG. 15A, therein is shown a second embodiment of the base plate assembly 112 which has been previously disclosed in FIGS. 12 and 13, showing the second embodiment of the base plate assembly 112 in a deployed position inside a shower unit 12.

Figure 15B:
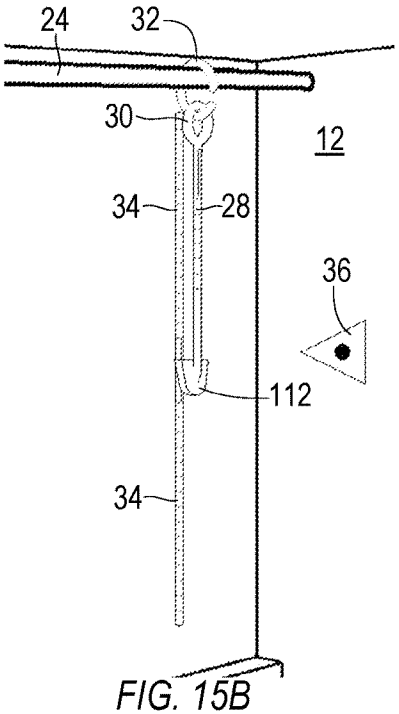
FIG. 15B is a perspective view taken from inside a shower unit showing a second embodiment of the base plate assembly in a stowed position.

Turning to FIG. 15B, therein is shown a second embodiment of the base plate assembly 112 which has been previously disclosed in FIGS. 12 and 13, showing the second embodiment of the base plate assembly 112 in a stowed position inside a shower unit 12.

Figure 16:
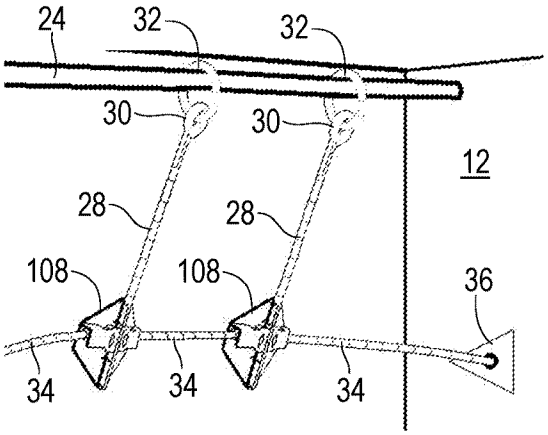
FIG. 16 is a perspective view taken from inside a shower unit showing a pair of a first embodiment of the base plate assembly in a deployed position in a wider shower unit.

Turning to FIG. 16, therein is shown a first embodiment base plate assembly assembly 108 wherein the shower unit 12 is wide enough to require a paired installation of the base plate assembly 108 connected by an additional segment of connecting rod 34 between the two base plate assemblies 108.

Turning to FIG. 17, therein is shown a stowage clip 86 as previously disclosed in FIGS. 7A-7C containing receptacles 52 and additionally having a pair of clips 90 thereon wherein the clips are sized to receive a rod 54 so that the rod 54 can be stowed in a vertical disposition by attaching a stowage clip to the vertical rod and then attaching the lateral rods into the clips 90. Clips 90 form a receptacle for frictionally holding the rod 54.

The following summary and general explanation of the present invention 10 is provided making reference to FIG. 1A to 17. The present invention 10 is comprised of the following components:

1. One Hanger Clip 30
2. Three Segmented Rods 54
   a. One Base Rod 28
   b. Two Folding Arm Rods 34
3. One Base Plate 26
4. Two Rotating Clips 70
5. Two Anchor Plates 36
6. One Stowage Clip 86

The components are organized into the following groups:

1. Hanging Arm Assembly Group
   a. Hanger Clip 30
   b. Base Rod 28
   c. Base Plate Assembly Group
      i. Base Plate Clip 26
      ii. Two Rotating Clips 70
   d. (Optional) Stowage Clip 86
2. Anchor Group
   a. Two Folding Arm Rods 34
   b. Two Anchor Plates 36

The present invention 10 is designed with a single, Hanging Arm Assembly Group as its base. The Hanging Arm Assembly Group is comprised of the Hanger Clip 30 at its top, Base Rod 28 in the middle and Base Plate Assembly 108, 112 at its bottom. The Base Plate Assembly Group can be placed on the Base Rod 28 to the user's selected preference of hanging height. With the Hanging Arm Assembly Group suspended in the center of a shower curtain 38, the two Folding Arm Rods 34 insert into and fasten to either side of the Base Plate Assembly Group.

The Folding Arm Rods 34 are normally cut to equal length and when not in use, are designed to be stowed vertically/parallel to the Base Rod 28 by either folding them upward or downward 90 degrees as the user 11 prefers to configure the device. If stowed in the up position, the Stowage Clip 86 is required as part of the Hanging Arm Assembly Group. This stowage configuration design minimizes the horizontal profile of the present invention 10 when not in use and ensures that the curtain 38 retains its ability to completely open for the user's 11 entry into and exit from the shower 12.

When it is deployed for use, the present invention's 10 Folding Arm Rods 34 pivot 90 degrees from their respective stowed positions on either side of the hanging arm assembly. Upon completion of that pivot, the Folding Arm Rods 34 should be horizontal to the ground, forming a single line that extends perpendicularly and (normally) equally from the bottom of the Hanging Arm Assembly Group at the center position of the shower curtain 38. In this configuration, the present invention 10 forms an inverted "T" shape.

The outer-most end of each Folding Arm Rod 34 is placed either into an existing anchor point in the shower wall or into the present invention's 10 anchor plates 36 that are attached to the shower walls 14, 16 as part of a system or kit. Each Folding Arm Rod 34 should be cut to a length that, when anchored, causes the base of the inverted "T" to arch outwardly from the shower space, either mildly or significantly per the user's 11 preference, e.g., chest 13 level. The base of the inverted "T" should measure to a length that arches at least enough to maintain its placement into the anchor points, while also holding the shower curtain 38 in place. The arch cannot, however, extend so far that it draws the bottom of the shower curtain 38 above the curb 22 at the bottom of the shower space 12, which would thereby compromise the water barrier it is purposed to provide.

Once installed, the present invention 10 takes only seconds to deploy or to stow. Once stowed, it is all but invisible to the user and has minimal effects on the opening or closing of the shower curtain 38 for which it is installed. Unlike similar products, it is adaptable to a wide range of shower 12 sizes and configurations, to include step-in showers, where other products require a well-pronounced bottom barrier in order to retain the bottom of the shower curtain 38.

The present invention 10 is a more universal and inexpensive solution to the commonly annoying problem of a wandering or encroaching shower curtain 38.

The description of the present embodiments of the present invention 10 has been presented for purposes of illustration, but is not intended to be exhaustive or to limit the invention to the form disclosed. Many modifications and variations will be apparent to those of ordinary skill in the art. As such, while the present invention 10 has been disclosed in connection with an embodiment thereof, it should be understood that other embodiments may fall within the spirit and scope of the invention as defined by the following claims.

I claim:

1. An apparatus for bracing a shower curtain away from a user in a shower, the shower having a shower curtain rod, comprising (a) a hanger clip configured for removable connection with the shower curtain rod;

(b) a base rod with a first end and a second and wherein the first end is connected with aid banger clip;

(c) a base plate assembly connected to said second end of said base rod;

(d) an arm movably connected with said base plate assembly, wherein said arm is moveable from an undeployed position to a deployed position wherein said deployed position is approximately perpendicular to said base rod, and e) wherein said base plate assembly has a base plate having front and rear sides, a vertical spine disposed on said front side containing a plurality of receptacles therein for receiving a plurality of arm segments, a right and a left U-shaped channels disposed on said front side, a right and a left rotation clips disposed in said corresponding right and left U-shaped channels, said rotation clips for receiving a plurality of arm segments, wherein each said arm segment is moveable from an undeployed position to a deployed position wherein said deployed position is approximately perpendicular to said base rod.

2. The apparatus of claim 1, wherein said arm is a pair of independent arms.

3. The apparatus of claim 2, wherein when in said deployed position said pair of arms form a curved arch structure such that said curved arch structure extends horizontally away from said second end of said base rod.

4. The apparatus of claim 2, wherein said pair of arms include a first end and a second end wherein the first ends are connected with said base plate and wherein the second ends are configured to removably connect with a side wall of the shower.

5. The apparatus of claim 2, further comprising an anchor plate attached to an end of said arm such that in the deployed state said anchor plate on each said arm removably connects with said side wall of the shower.

6. The apparatus of claim 1, wherein when in said deployed position said arm forms a curved arch structure such that said curved arch structure extends horizontally away from said second end of said base rod.

7. The apparatus of claim 1, further comprising more than one said base rod, said base plate, and said arm.

8. A method for bracing a shower curtain away from a user in a shower, the shower having a shower curtain rod, comprising the steps of:

(a) providing a hanger clip configured for removable connection with the shower curtain rod;

(b) removably connecting a first end of a base rod with the hanger clip;

(c) connecting a base plate assembly with a second end of the base rod;

(d) movably connecting an arm with the base plate assembly so that the arm is moveable from an undeployed position to a deployed position, wherein the deployed position is approximately perpendicular to the base rod, and (e) providing the base plate assembly with a base plate have front and rear sides, a vertical spine disposed on the front side containing a plurality of receptacles therein for receiving a plurality of arm segments, a right and a left U-shaped channels disposed on the front side, a right and a left rotation clips disposed in the corresponding right and left U-shaped channels, the rotation clips for receiving a plurality of arm segments, wherein each arm segment is moveable from an undeployed position to a deployed position wherein the deployed position is approximately perpendicular to the base rod.

9. The method of claim 8, wherein the arm is a pair of independent arms.

10. The method of claim 9, wherein when in the deployed position the pair of arms form a curved arch structure such that the curved arch structure extends horizontally away from the second end of the base rod.

11. The method of claim 9, wherein the pair of arms include a first end and a second end wherein the first ends are connected with the base plate and wherein the second ends are configured to removably connect with a side wall of the shower.

12. The method of claim 9, further comprising the step of providing an anchor plate attached to an end of the arm such that in the deployed state the anchor plate on each arm removably connects with the side wall of the shower.

13. The method of claim 8, wherein when in the deployed position the arm forms a curved arch structure such that the curved arch structure extends horizontally away from the second end of the base rod.

14. The method of claim 8, further comprising the step of providing more than one base rod, base plate, and arm.

* * * * *